US005608954A

United States Patent [19]

Vernay

[11] Patent Number: 5,608,954

[45] Date of Patent: Mar. 11, 1997

[54] PILE FABRIC MANUFACTURING PROCESS AND RESULTING FABRICS

[75] Inventor: Rene J. Vernay, St. Andre D'Apchon, France

[73] Assignees: A. Vernay et Fils Sarl; Andre Vernay Teintures, S.A.

[21] Appl. No.: 500,866

[22] PCT Filed: Feb. 1, 1994

[86] PCT No.: PCT/FR94/00123

§ 371 Date: Aug. 2, 1995

§ 102(e) Date: Aug. 2, 1995

[87] PCT Pub. No.: WO94/18368

PCT Pub. Date: Aug. 18, 1994

[30] Foreign Application Priority Data

Feb. 2, 1993 [FR] France ..... 93 01368

[51] Int. Cl.[6] ..... D06C 23/02

[52] U.S. Cl. ..... 28/162

[58] Field of Search ..... 28/162; 66/194, 66/195

[56] References Cited

PUBLICATIONS

DE 2924369, Date May 1980, Abstract.
FR 2286907, Date Jun. 1976, Abstract.

*Primary Examiner*—John J. Calvert
*Attorney, Agent, or Firm*—Harris Beach & Wilcox, LLP

[57] ABSTRACT

A method for producing a polar fabric knitted upon a loop yarn loom with 100% polyester multi-filament yarn prior to treating the fabric with disperse dyes. The method includes first napping the loop side of the fabricwith a napper having opposed bristles for pulling the fabric loops and then napping the treated side of the fabric with a felting napper to compact the fabric.

8 Claims, 2 Drawing Sheets

PILE FABRIC MANUFACTURING PROCESS AND RESULTING FABRICS

BACKGROUND OF THE INVENTION

The object of the invention, which relates to the technical aspects of textile dyeing and finishing, is the production of a so-called "piled" fabric.

Piled fabric, as is well-known to persons skilled in the art, is the result of knitting 100% polyester multifilaments on a warp-knitting machine. Several counts and filament quantities can be used; 160 decitex, 96 filaments are the most common.

The knitted fabric is disperse-dyed using conventional methods for dyeing 100% polyester. The resulting fabric has a plush-loop and a smooth side.

SUMMARY OF THE INVENTION

The present invention is a method of finishing various piled fabrics most notably piled fabrics with a napped, furry, lambskin or fleeced appearance. The invention discloses methods of making self-shaded, clouded or printed fabrics for each of these appearances.

First, to produce a finished piled fabric with a single napped side and a self-shaded appearance,

- the plush-loop side of the piled fabric is raised at least once in the direction of and against the pile using a napper to pull the backing meshes.
- the side thus treated is raised at least once more using a felting napper to compact the backing.

When a piled fabric with two napped sides and a self-shaded appearance is required,

- the plush-loop side of the piled fabric is raised at least once in the direction of and against the pile using a napper to pull the backing meshes.
- the side thus treated is raised at least once more using a felting napper to compact the backing.
- the reverse or smooth side of the fabric is subjected to at least one raising operation in the direction of and against the pile using a napper to pull the backing meshes.
- the reverse side thus treated is raised at least once more using a felting napper to compact the backing.

Between 10 and 50% black yarn is added to the multifilament to produce a fabric with a clouded appearance.

To produce a finished fabric with a printed appearance, the fabric is laundered first and subsequently printed on the plush-loop side.

To produce a finished fabric with a furry appearance, it is first treated as if a napped fabric were required with a pile-bursting treatment to elongate the backing meshes, after which the fabric is plushed and shorn.

To produce a finished fabric with a lambskin appearance, it is first treated as if a napped fabric were required, after which it is washed for roughly 20 minutes at approximately 40° C. and roughly 30 minutes at approximately 120° C.

A fleece-type appearance is produced by subjecting the sides of the fabric to a bursting operation to elongate the backing meshes, after which the fabric is plushed and washed for roughly 20 minutes at approximately 40° C. and for roughly 30 minutes at approximately 120° C.

BRIEF DESCRIPTION OF THE DRAWINGS

In order that the invention may be more readily understood, the following description makes reference to the accompanying drawings.

The following description will be more easily understood when it is remembered that pile fabric is first produced on a warp-knitting machine using 100% polyester multifilaments. The knitted fabric is disperse-dyed on appropriate machines using widely known methods for dyeing 100% polyester yarn.

Figure 1:
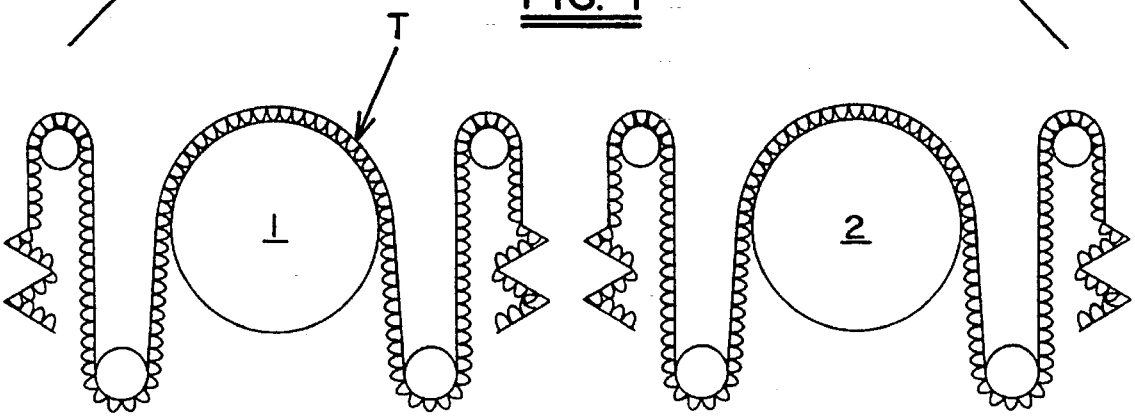
FIG. 1 is a diagrammatic representation of the raising principle used to produce a napped appearance on one side of the piled fabric.

As is shown in FIG. 1, a napped appearance on one side of the piled fabric is produced by subjecting the fabric to 4 finishing operations on different machines, 2 raising operations on "carding" machine (1) and 2 felting operations on "felting" machine (2).

Figure 2:
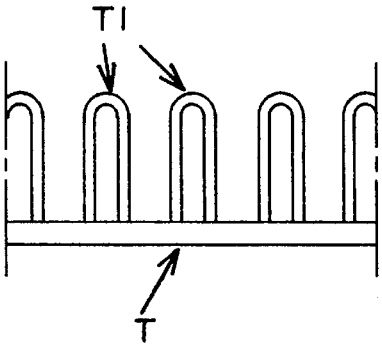
FIGS. 2, 3, 4 and 5 are enlarged diagrammatic representations of the fabric in its various processing stages.
Figure 3:
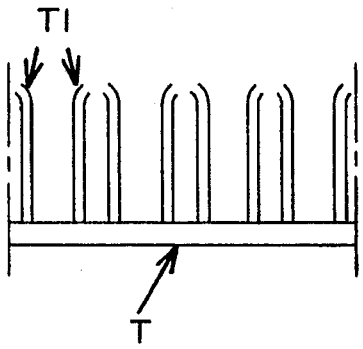

During the first two treatments on machine (1) the filaments are pulled and burst. FIG. 2 shows the fabric before plushed side (T1) is run through the machine, while FIG. 3 shows the same fabric after it has been run through machine (1).

Figure 4:
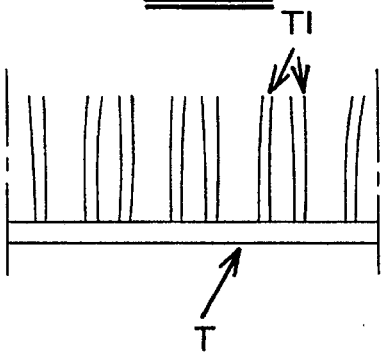
Figure 5:
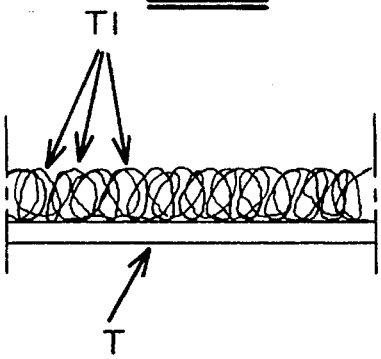

The remaining two operations on machine (2) compact the pile backing and mingle the filaments to produce an appearance of greater density (FIGS. 4 and 5). The microscopic filaments having been burst and mingled, the resulting appearance is one of perfect uniformity and smoothness.

Figure 6A:
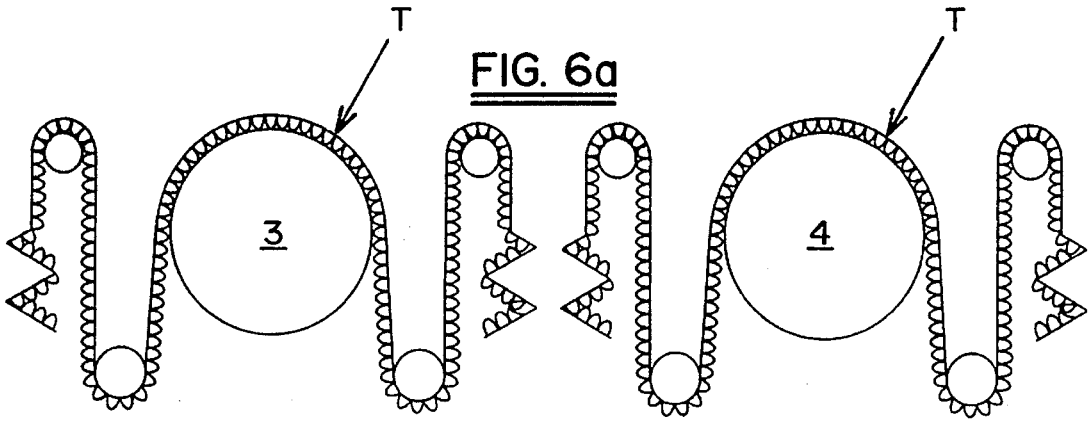
FIG. 6 corresponds to FIG. 1, showing how a double-side napped fabric is produced.
Figure 6B:
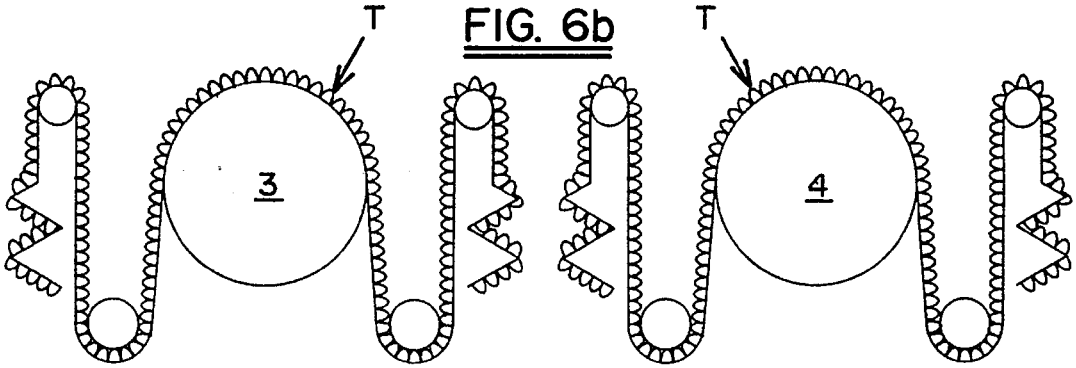

When it is required to produce this self-shaded napped appearance on both sides, the plushed side of the fabric is raised twice as explained previously, i.e. using raising machines (1) and (2). The reverse or smooth side is raised four times on machines (3) and (4). Running the fabric twice through raising machine (3) will compact the pile backing, mingling the piles. The same happens on machine (4)(FIG. 6).

The plushed and smooth sides of the fabric can subsequently be felted, each on two different machines.

Using the basic concept of treating the fabric on one or on both sides to produce a nap allows the visual appearance to be modified by subjecting the piled fabric thus treated to further specific operations.

Figure 7A:
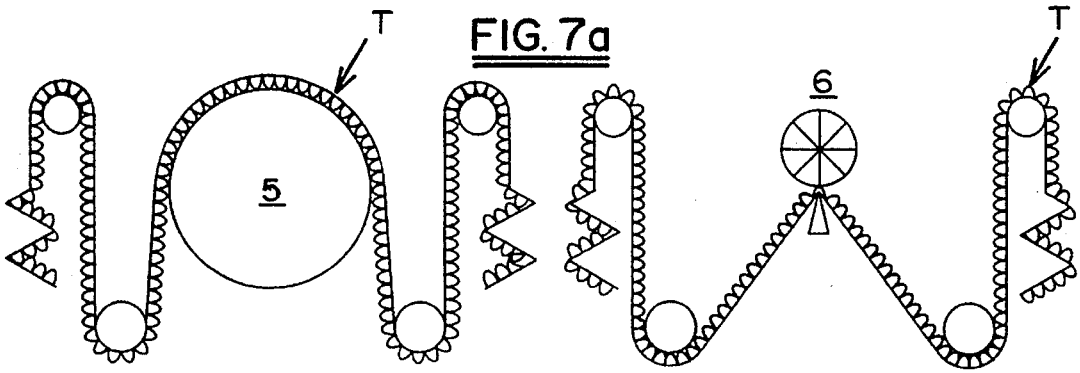
FIG. 7 is a diagrammatic representation showing the raising principle used to produce a pile fabric with a furry appearance.
Figure 7B:
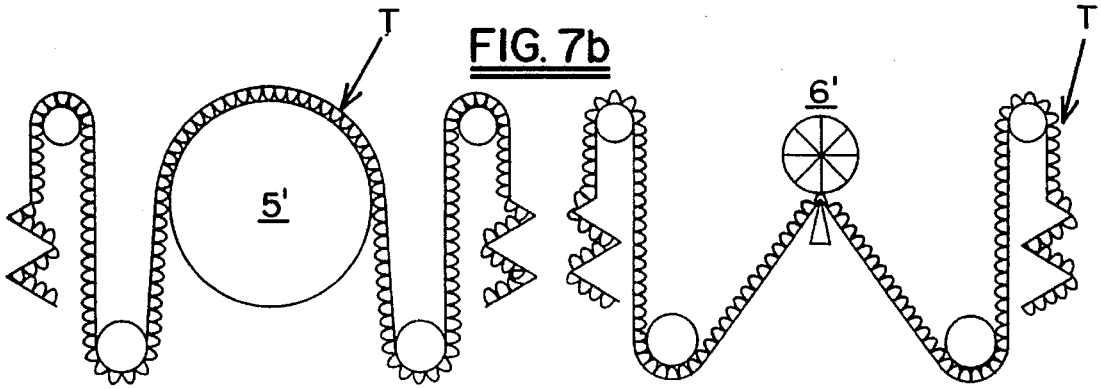

To produce a furry appearance, the fabric is subjected to a bursting operation using machine (5) to elongate the backing meshes and subsequently to a plushing and shearing operation (6) as shown in FIG. 7. The operation is advantageously repeated again, submitting the side thus treated to the action of the machines (5') and (6').

To produce a lambskin appearance having subjected the side or sides of the fabric to a bursting operation followed by plushing and shearing, the fabric is washed for roughly 20 minutes at approximately 40° C. The detergent used should be combined with a softener and the pile fabric is subsequently subjected to a second drying operation at 120° C. for roughly 30 minutes.

To produce a fleeced appearance, the same procedure is adopted as for producing a lambskin appearance, the only difference being that the fabric is not shorn, thus keeping the piles long.

The various procedures described produce a pile fabric with a napped, furry, lambskin or fleeced appearance with, in each case, a self-shaded appearance.

To produce a clouded appearance, and prior to submitting the fabric to the various operations described, 10 to 50% black yarn is added to the multifilaments.

To produce a printed appearance, the fabric is first washed and subsequently printed on the plushed side.

The benefits of the invention are clearly apparent from the description, especially as regards the possibility of producing a pile fabric with one or both sides having a napped, furry, lambskin or fleeced appearance and, for each of these, a self-shaded, clouded or printed appearance.

I claim:

1. A finishing process for a polar fabric, said fabric having a plush-loop side and a smooth side, said fabric being knitted on a plush loom and made from 100% polyester multi-filaments in which the fabric has been subjected to a dyeing operation by means of diverse dyes, wherein the process is characterized by the steps of:

pulling said filaments of at least one side of said fabric in a raising apparatus;

bursting said pulled filaments of said at least one side of said fabric in a second napping operation;

compacting said burst filaments of said at least one side of said fabric in a third napping operation;

mingling said filaments of said at least one side of said fabric in a fourth napping operation to produce at least one felted fabric surface having a high density of fiber filaments;

raising said at least one felted side of said fabric to extend the mingled filaments; and shearing the extended mingled filaments to produce at least one fabric surface having a velvety finish.

2. A process as recited in claim 1, wherein black colored threads are added to the multi-filaments in a proportion of approximately 10 to 50 percent prior to said finishing process to produce a finished fabric having a cloudy appearance.

3. A process as recited in claim 1, including the additional step of bleaching said fabric prior to said finishing process.

4. A process as recited in claim 3, including the further step of printing said fabric after said bleaching step.

5. A finishing process for a polar fabric, said fabric having a plush-loop side and a smooth side, said fabric being knitted on a plush loom and made from 100 percent polyester multi filaments in which the fabric has been subjected to a dyeing operation by means of diverse dyes, wherein the process is characterized by the steps of:

pulling said filaments of at least one side of said fabric in a raising apparatus;

bursting said pulled filaments of said at least one side of said fabric in a second napping operation;

compacting said burst filaments of said at least one side of said fabric in a third napping operation;

mingling said filaments of said at least one side of said fabric in a fourth napping operation to produce at least one fabric side having a felted surface;

raising said at least one fabric side to extend the mingled filaments;

shearing the extended mingled filaments in a raising apparatus;

washing said processed fabric for approximately 20 minutes at approximately 20 C.; and drying said processed fabric for approximately 30 minutes at approximately 120 C. to produce a fabric surface having a sheepskin-like finish.

6. A process as recited in claim 5, wherein black colored threads are added to the multi-filaments in a proportion of approximately 10 to 50 percent prior to said finishing process to produce a cloudy appearance in said finished fabric.

7. A process as recited in claim 6, including the step of bleaching said fabric prior to said finishing process.

8. A process as recited in claim 7, including the step of printing said fabric after said bleaching step.

* * * * *